US009644873B2

(12) United States Patent
Teckman et al.

(10) Patent No.: US 9,644,873 B2
(45) Date of Patent: May 9, 2017

(54) METHOD AND APPARATUS FOR REFRIGERATION SYSTEM ENERGY SIGNATURE CAPTURE

(71) Applicants: Timothy Teckman, Beaverton, OR (US); Christoper Chaput, Portland, OR (US); Jeffery Lassahn, Portland, OR (US); Steven Kassel, Beaverton, OR (US); Nelson Yaple, Bend, OR (US)

(72) Inventors: Timothy Teckman, Beaverton, OR (US); Christoper Chaput, Portland, OR (US); Jeffery Lassahn, Portland, OR (US); Steven Kassel, Beaverton, OR (US); Nelson Yaple, Bend, OR (US)

( * ) Notice: Subject to any disclaimer, the term of this patent is extended or adjusted under 35 U.S.C. 154(b) by 364 days.

(21) Appl. No.: 14/608,439

(22) Filed: Jan. 29, 2015

(65) Prior Publication Data

US 2016/0223252 A1 Aug. 4, 2016

(51) Int. Cl.
*F25D 29/00* (2006.01)
*F25B 49/00* (2006.01)

(52) U.S. Cl.
CPC ..... *F25B 49/005* (2013.01)

(58) Field of Classification Search
CPC ..... F25B 49/005; G01R 19/155; G01R 29/24; G08B 21/182; H01R 13/6691; H02H 3/04
USPC ..... 340/657
See application file for complete search history.

(56) References Cited

U.S. PATENT DOCUMENTS

2004/0261431 A1* 12/2004 Singh ..... F25B 49/005 62/125
2014/0126081 A1* 5/2014 Huang ..... G11B 19/048 360/75

* cited by examiner

*Primary Examiner* — Omer S Khan
(74) *Attorney, Agent, or Firm* — Mohr Intellectual Property Law Solutions, PC

(57) ABSTRACT

Systems and methods for monitoring and diagnosing refrigeration equipment including one or more monitoring devices, a data collection and communication hub in communication with the monitoring devices, and in communication with an analysis means. In some examples, the systems and methods include an Internet accessible cloud-based analysis means. In some further examples, the systems and methods include analysis means implemented on locally networked computers.

12 Claims, 5 Drawing Sheets

METHOD AND APPARATUS FOR REFRIGERATION SYSTEM ENERGY SIGNATURE CAPTURE

BACKGROUND

The present disclosure relates generally to systems and methods for monitoring and diagnosing commercial refrigeration systems. In particular, monitoring and diagnostic systems that sample and analyze the energy consumption signature of refrigeration system components are described.

Commercial refrigeration systems are widely used in supermarkets, restaurants and retail outlets. These systems consume large amounts of electricity at substantial cost. In addition, failures of these systems can lead to product and financial loss. Examination of the energy consumption of the individual components of a commercial refrigeration system can determine if the system is operating efficiently and if one or more components of the system is likely to fail. Proper examination of the energy consumption includes transient and steady state voltage, transient and steady state current and the environmental conditions that system is operating in. This invention is the design of a system to capture and record information necessary to make a proper examination of commercial refrigeration energy consumption.

Known systems and methods are not entirely satisfactory for the range of applications in which they are employed. For example, maintenance of refrigeration systems has historically been performed using some combination of scheduled maintenance and as-needed servicing. Scheduled maintenance, while important and proven to save money, is typically based on the expected wear and lifetime of serviced components and usually does not account for potential defective parts or unusual wear situations. These conditions might lead to a premature failure prior to scheduled maintenance. Furthermore, inspections during scheduled maintenance may not be able to detect a looming failure where the equipment looks visibly intact. Conversely, as-needed service is inherently reactive in nature, repairing equipment that has already suffered failure. Failed equipment potentially results in lost revenue to the equipment owners.

Thus, there exists a need for systems and methods for monitoring and diagnosing refrigeration equipment that improve upon and advance the design of known systems and methods. Examples of new and useful systems and methods relevant to the needs existing in the field are discussed below.

SUMMARY

The present disclosure is directed to systems and methods for monitoring and diagnosing refrigeration equipment which include one or more monitoring devices hooked into the electrical supply of various refrigeration equipment components, and a data collection and communications hub in communication with the monitoring devices and an analysis means. In some examples, the systems and methods include an Internet accessible cloud-based analysis means. In some further examples, the systems and methods include analysis means implemented on locally networked computers.

DETAILED DESCRIPTION

The disclosed systems and methods will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various systems and methods are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

In order to look for faults in a refrigeration system, the disclosed systems and methods use a technique known as Power Signature Analysis (PSA). The individual pieces of equipment in a refrigeration system, such as the compressor, evaporator fan motors, and condenser fan motors, have failure modes that can be detected by examining the electrical power consumed by the equipment. The signal for these failure modes include changes to the start-up power waveform, increases in the average power consumed, and short-cycling of the equipment. For example, a motor with a bearing that is starting to stick or go bad may show an increase in the amount of current drawn (and potentially a corresponding drop in line voltage) upon startup when compared to the current draw profile for a known good motor. The disclosed systems and methods make the measurements required to look for these signals and analyze the measurements for short and long term faults in the monitored refrigeration system.

Figure 1:
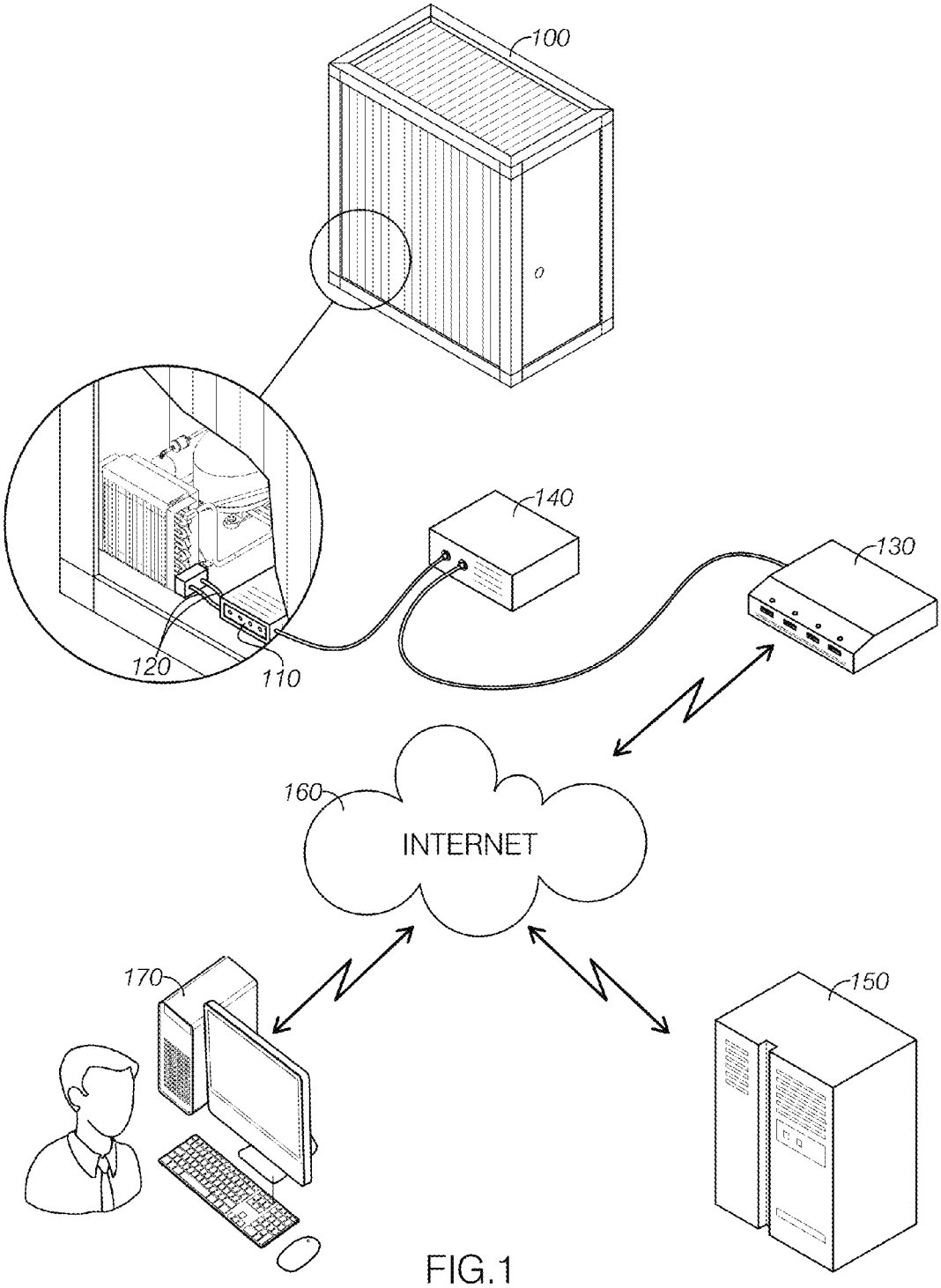
FIG. 1 is a system diagram of a first example of a system for monitoring and diagnosing refrigeration equipment.

With reference to FIGS. 1-5, a first example of a system for monitoring and diagnosing refrigeration equipment, system 10, will now be described. As depicted in FIG. 1, system 10 includes a refrigeration unit 100, one or more monitoring devices 110 attached to power lines 120, a data collection hub 130 that is in communication with monitoring devices 110 over a data network 140, an analysis means 150 to analyze the collected data which receives the data from the data collection hub 130 over a wide-area network 160, and finally a user terminal 170 which can communicate with the analysis means 150 over wide-area network 160 so as to receive the results from analyzing the collected data.

Figure 2:
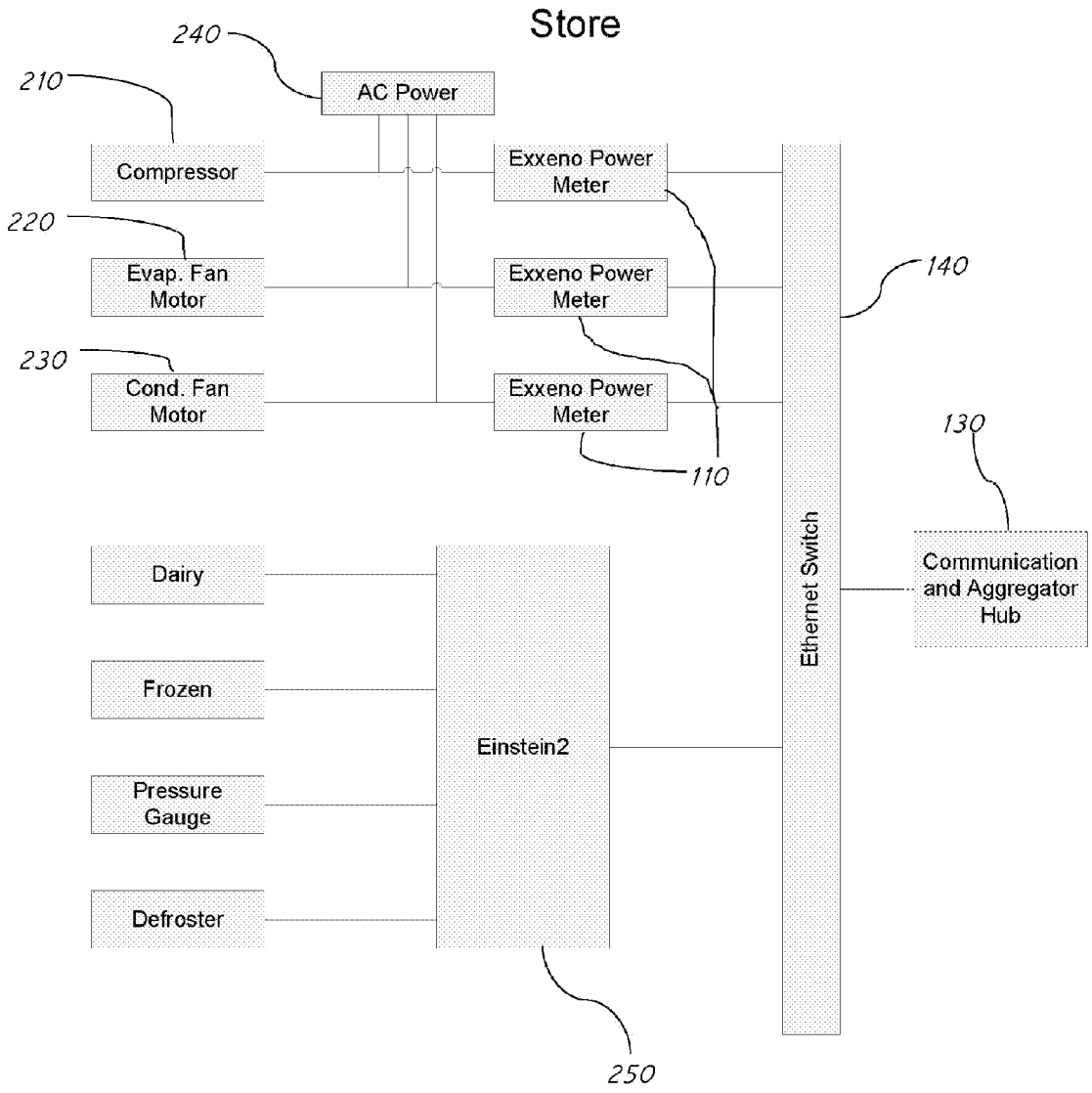
FIG. 2 is a block diagram of the system for monitoring and diagnosing refrigeration equipment shown in FIG. 1 depicting the components of the commercial refrigeration system.

Referring to FIG. 2, refrigeration unit 100 is a typical commercial refrigeration unit, which possesses multiple powered components such as a refrigerant compressor 210, evaporator fan motor 220, and condenser fan motor 230, each supplied by AC: power 240. Each of these components exhibits a unique power draw signature when starting up, and again when they reach a steady operating state. A monitoring device 110 is attached to the power input on each of the components to monitor the power demands of each independent component, as shown in FIGS. 1 and 2. Also shown in FIG. 2 is a refrigeration system control device 250. In addition to controlling systems such as turning compressors, fans and defrosters on and off as needed to maintain the specified temperatures, control device 250 collects different types of data relevant to the refrigeration system, such as temperatures and pressures. Other data may optionally be collected directly by the data collection hub 130 such as the open/closed status of doors, or such information may be collected by the control device 250. The data collection hub 130 queries the refrigeration system control device 250 for information it collects, and forwards this data to the analysis means 150 for use in the analysis, as will be discussed further herein.

The monitoring devices 110 ideally measure voltage and current usage at both high and low speed sampling rates. Monitoring devices 110 can be configured to measure all three legs of three phase power, as may be used in a commercial refrigeration installation, or a single leg of single phase power. A monitoring device 110 may be triggered when the device it is connected to turns on and the current crosses a configurable trigger threshold. In the example embodiment, the monitoring device 110 records current and voltage values at 12 kHz for a predetermined length of time, in the example embodiment, 30 seconds, and transmits it to the data collection hub 130. After the 30 seconds, the monitoring device 110 changes mode and starts calculating the average power consumption. The data collection hub 130 queries the monitoring device 110 for the average power and other configurable values such as power factor, average current, and average voltage once per second. The data collection hub 130 stores and forwards this data to an analysis means. The monitoring device 110 can be configured to stop its measurements when the average current goes below a configurable threshold and resets its trigger to look for the high-speed acquisition trigger condition.

In other implementations, the measuring devices 110 continuously sample voltage and current at a set sampling rate. In the example embodiment, the measuring devices 110 run a continuous sample rate of 12 kHz, and compute the average values at a rate of once per second from the data immediately sampled at 12 kHz. Each average value is the average of the previous second's (or other time period if computed at a different rate than once per second) set of samples. Accordingly, at a rate of 12 kHz and average computation of once per second, each average value is an average determined from 12,000 samples. It will be appreciated by a person skilled in the relevant art that the 12 kHz rate is just one possible speed; a range of high speed sampling can be employed without departing from the scope of this invention. For example, sampling speeds as low as 5 kHz, and potentially lower, could be employed. The lower threshold for high-speed sampling ultimately is determined by the nature of the equipment being monitored; the speed must provide sufficient resolution to perform meaningful Power Signature Analysis on the equipment being monitored. A lower sample speed could be employed where buffer space to store high speed sample data is limited, and/or where a greater window of available high-speed data is desired. Likewise, the rate of low-speed average reporting can be varied from one second averages to shorter or greater times depending on the equipment being monitored, and the needs of the equipment owner. Furthermore, it will be appreciated by a person skilled in the relevant art that the method of computing average values from the raw sampled data may be implemented using a variety of mathematical methods, such as a straightforward averaging (arithmetic mean, computed by dividing the sum of the samples by the number of samples summed), root mean squared computation, statistical values such as median or mode, or any other method of deriving a meaningful value from the raw sample data.

Where the measuring device 110 performs high speed sampling continuously, a sliding window of high-speed samples can be implemented. This will allow for looking backwards from the point at which the voltage or current sampling thresholds are exceeded. For example, by implementing a rolling thirty second cache of sample data, when the voltage or current thresholds are crossed, the previous thirty seconds of high speed sample data leading up to the trigger point can be marked for saving and analysis, in addition to the thirty seconds following the trigger point. In this way, the power usage signature leading up to the threshold trigger can be determined as well as the power usage signature following the trigger, which could provide greater insight into the equipment's health and failure mode. Example monitoring devices 110 that are suitable for use with the disclosed invention are made by Dent Instruments, such as their PowerScout™ 3037 Networked Power Meters.

As discussed above, sample rates and times and trigger threshold current limits may vary depending on the nature of the equipment being monitored. Moreover, what happens when a trigger threshold is crossed depends on the nature of the measuring device 110: if the measuring device 110 is inactive or sampling at a slow rate, exceeding the threshold can cause the measuring device 110 to switch to a high-speed sampling mode. Where the measuring device 110 continuously samples at a high rate and computes average values from the high-speed samples, exceeding the trigger threshold may either cause the measuring device 110 to begin outputting the raw high-speed sample data in lieu of or in addition to the average values. In still other possible implementations, the data collection hub 130 can be configured with the trigger threshold, and will query the tripped monitoring device 110 for high-speed sample data if the data collection hub 130 detects the average values have exceeded the trigger threshold.

In one implementation, the trigger threshold current limit may be configured to be just above the expected normal maximum current draw of the monitored equipment, so that monitoring is initiated if the monitored equipment draws higher-than-normal startup current. Likewise, the length of time that high-rate sampling is performed ideally is tailored to the startup profile of the monitored equipment. The length of time it takes the equipment to normally start and come to a steady running state should be considered, and the high-rate sampling time ideally set so that any anomalies are detected. This could include the possibility that the startup time may be abnormally increased when the equipment is experiencing a problem. Alternatively, depending on the needs of the implementing user the system may be configured to begin sampling any time a current draw from the monitored equipment is detected. Other possible implementations can use multiple trigger thresholds. In addition to the trigger threshold for initiating collection of high-speed sample data, a trigger threshold can be set that will return the monitoring device 110 to low-speed average reporting, and can be used either in lieu of or in connection with a fixed timer for high-speed sampling. Still other trigger thresholds can be configured to instruct the monitoring device 110 to begin or end monitoring the energy usage of its attached device. Tripping such a threshold could initiate low-speed average reporting or high-speed sampling, and could be useful where the monitored component does not run continuously, serving to start and stop the monitoring device 110 as the monitored component is switched on or off. This would allow for reduction of the system's data requirements, as equipment would only be monitored when necessary.

The data collection hub 130 is in data communication with the various monitoring devices 110, and collects sampled data from the various monitoring devices 110. The data collection hub 130 and monitoring devices 110 can be connected via any now known or later developed networking technology, such as Ethernet, Bluetooth, NFC, WiFi, or fiber optic cabling. The data collection hub 130 is further connected to the analysis means 150. The manner in which the data collection hub 130 connects to analysis means 150 will depend on the nature of the analysis means 150. If the analysis means 150 is implemented local to the data collection hub 130, then the data collection hub 130 and the analysis means 150 may be connected using the same network and networking technology used to connect the data collection hub 130 to the monitoring devices 110. Conversely, if the analysis means 150 is hosted remote to the site of the data collection hub 130, then the data collection hub 130 may be connected to the analysis means 150 by use of any known or later developed wide-area networking technology. In one possible implementation, the data collection hub 130 may use the Internet to communicate with an analysis means 150 implemented as a cloud service. The data collection hub 130 may implement data storage of both average and high-speed sampling data for times when transmission to the analysis means 150 is not possible, or if a continuous connection to the analysis means 150 is not desired, such as when analysis means 150 is implemented as a remote or cloud-based service, in communication with the data collection hub 130 over a wide-area network such as the Internet. In such cases, the data collection hub 130 will store average and high-speed sampling data until it reconnects to the analysis means 150, and then transmits all its stored data.

The data collection hub 130 may also facilitate remote control and configuration of the various monitoring devices 110. This is especially desirable when the analysis means 150 is located local to the data collection hub 130, such as on-premises, but also can be implemented using a remotely located analysis means 150. In this way, users of the system 10 can control and configure the various monitoring devices 110 and the data collection hub 130 from a single user terminal 170. Alternatively, the data collection hub 130 may implement an Internet-accessible configuration interface to allow for direct control and configuration of the system 10 via any Internet or network connected user terminal 170, without the need to go through the analysis means 150.

Figure 3:
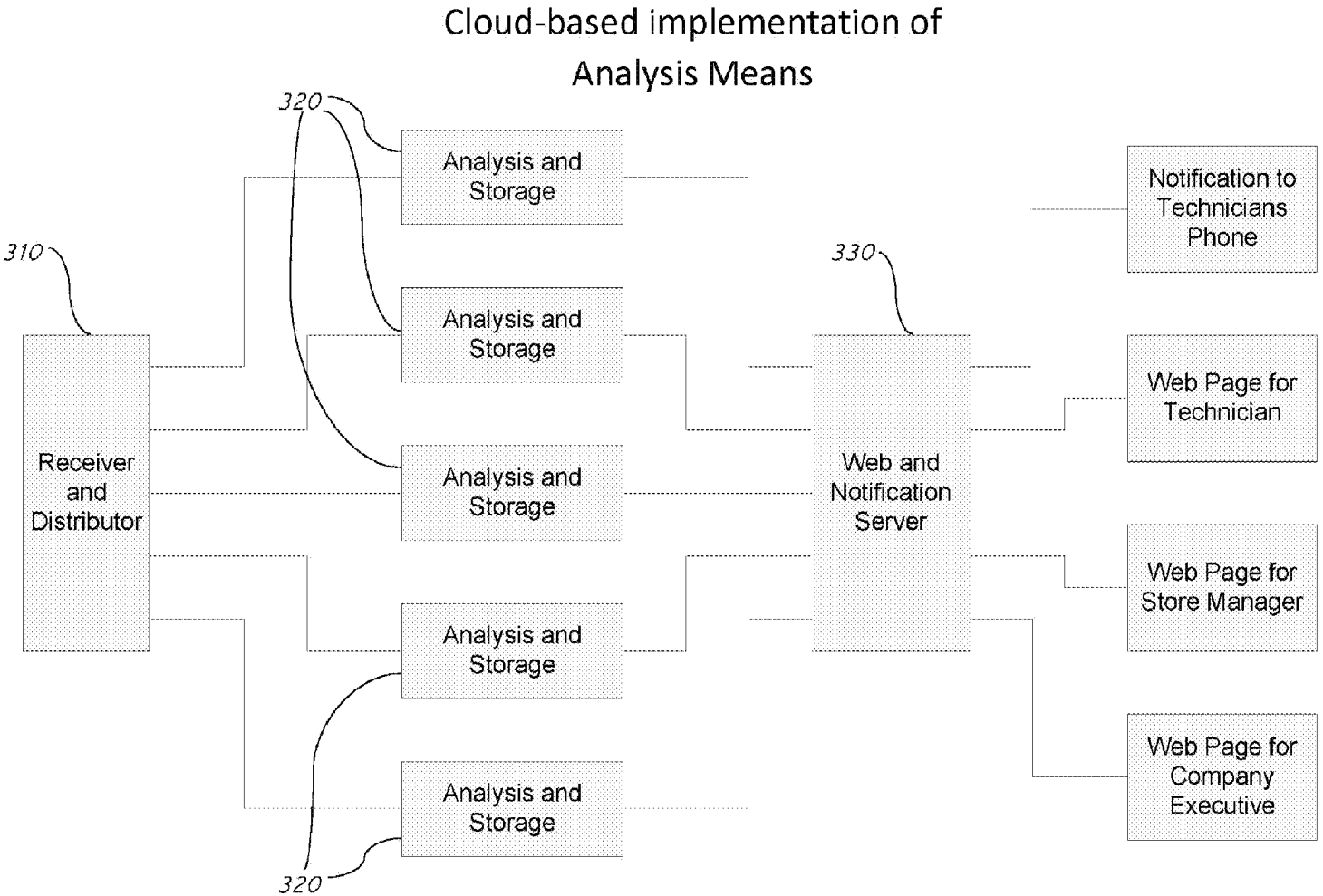
FIG. 3 is a block diagram of the system for monitoring and diagnosing refrigeration equipment shown in FIG. 1, depicting the components of an example cloud-based implementation of the analysis means.
Figure 4:
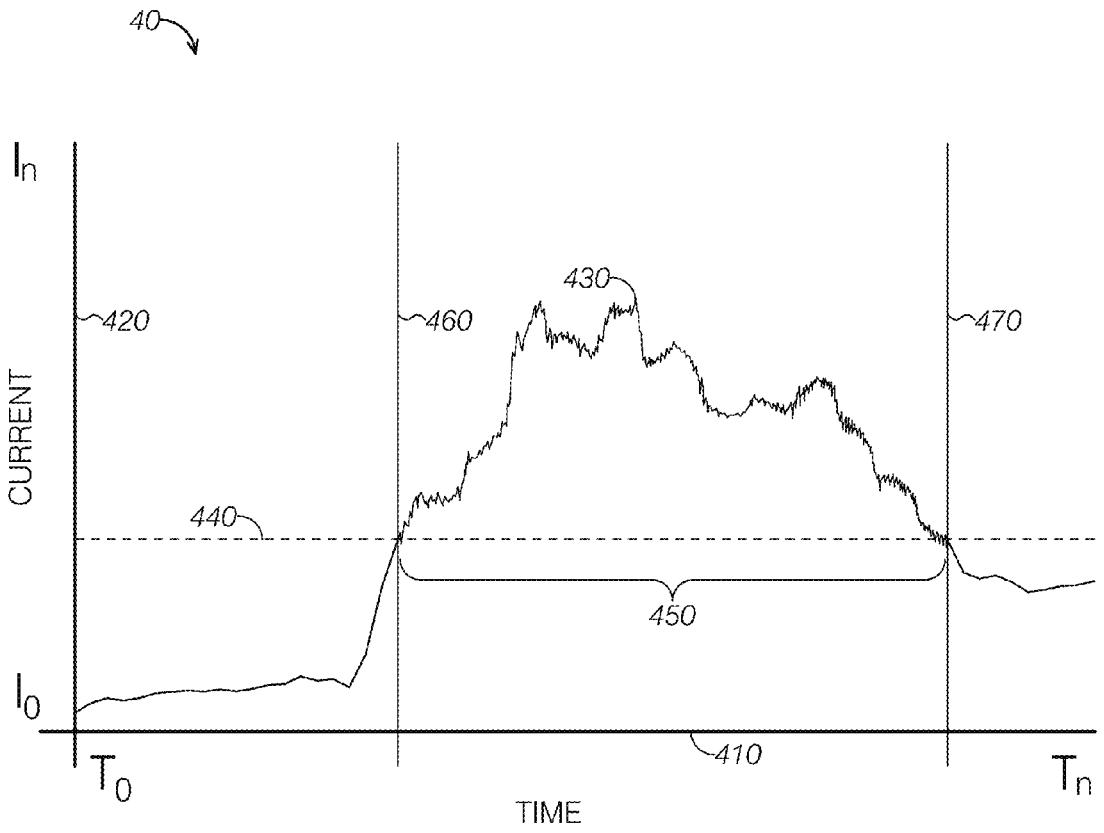
FIG. 4 is an example graph generated from power usage data collected by the system for monitoring and diagnosing refrigeration equipment, useful for power signature analysis.

Turning to FIG. 3, an example implementation of the analysis means 150 implemented as a remotely-hosted cloud service is depicted. A Receiver and Distributor 310 is connected to a wide-area network, such as the Internet, and receives data over the network from various sites that have implemented a network of measuring devices 110 and a data collection hub 130. It then distributes site-specific received data to a site-specific Analysis and Storage (A&S) process 320. Ideally, there is one A&S process 320 per site. The A&S processes 320 can be distributed across multiple computers in the cloud. The A&S process 320 performs the PSA algorithms, looks for trends in the results, prepares reports, and alerts the Web and Notification (W&N) server 330 if a high priority notification needs to be sent out to alert a customer or maintenance tech of a critical issue. The A&S process 320 also supplies data and reports to the W&N server 330 as requested. Examples of this data are power consumption versus time graphs and power consumption versus ambient temperature graphs. An example of such a graph is depicted in FIG. 4. Examples of reports are site status, repair status, and regional energy savings. These reports are customized to needs of the user. Maintenance people need the status of all equipment, but do not need access to the regional energy consumption. Site managers need site status and information about scheduled maintenance, but may not need regional status information. The W&N server 330 controls access to this information. Notifications can be sent via email or SMS message to interested parties as needed. Reasons to send a notification might include a failing compressor or fan motor, a refrigerated space crossing a temperature threshold that is unsafe for the products being refrigerated, and pressure measurements exceed specification, possibly indicating a failure.

The analysis means 150 could also be implemented using a locally-based computer, in communication with the data collection hub 130 over a local area or campus-wide network. In such an implementation, the analysis means 150 may be a single server, implemented on commonly available server equipment, typical of the file or data servers routinely used in business, and manufactured by such companies as Dell®, IBM®, Lenovo®, HP®, or such similar companies. Such a server could run Microsoft Windows®, Linux, Mac OS X, or some other flavor of Unix. In such an implementation, the server used for the analysis means 150 can run software designed to receive the data from the data collection hub 130, perform the PSA algorithms, and make the various reports, notifications, and graphs available to a user situated at a user terminal 170.

User terminal 170 can be a stand-alone computer with Internet access, so as to enable access to a cloud-based analysis means 150. Where the analysis means 150 is implemented as a file server locally connected to the data collection hub 130, Internet access may be unnecessary. Depending on how the software running on the analysis means 150 is implemented, the user terminal 170 may run custom client software that interfaces with the software running on the analysis means 150, or may simply utilize a commonly used web browser such as Google Chrome, Microsoft Internet Explorer®, Firefox®, or Apple's Safari. Furthermore, where the analysis means 150 is implemented on a local server, user terminal 170 and analysis means 150 may be the same machine, with the analysis means 150 providing a user interface. In yet another possible implementation, the user terminal 170 can be implemented as an app that runs on a smartphone such as an Apple iPhone®, Android® phone, or Windows phone, and interfaces with the analysis means 150.

Referring to FIG. 4, an example graph 40 of electric current usage data for a monitored component of a refrigeration system is provided. This graph 40 is one possible example of a graphical presentation that the analysis means 150 can provide to a user. The graph 40 is comprised of an X-axis 410 representing time, with some arbitrary time zero starting at the origin; a Y-axis 420 representing electric current consumption, with zero current starting at the origin; a trace line 430 representing the changing current level with respect to time; a trigger threshold level 440; a high-speed sampling window 450; and high-speed window start point 460 and stop point 470.

This example graph 40 depicts the current measured by a monitoring device 110, which is used for Power Signature Analysis. The high-speed sampling window 450 is bracketed by start point 460 and stop point 470. The trace line 430 is plotted using one-second average data points as long as the trace line is below the trigger threshold level 440, representing a current draw by the monitored device that is below the trigger threshold set on the monitoring device 110. Once the current draw exceeds the trigger threshold, the monitoring device 110 outputs full sampled data at a 12 kHz rate, shown by the trace line 430 having a finer contour and detail following start point 460. When the monitoring device 110 switches back to a low-speed average output, the trace line 430 returns to a coarser contour, denoted by stop point 470. Depending on the system configuration, stop point 470 can either be after some pre-established length of time (such as 30 seconds) has elapsed, or it can be triggered when the current draw falls below the trigger threshold. It will also be appreciated by a person skilled in the relevant art that the graph 40 could be used to represent measurements other than current draw, such as voltage change, power consumption (a product of current and voltage), or any other relevant electrical measurement. Depending on the measurement employed, the graph 40 may appear different, such as when voltage is measured. As voltage levels typically vary inversely with current draw depending on the power supply utilized, a high voltage level would be expected when current draw is minimal, with lower voltage levels seen as current draw increases. A graph 40 of voltage, then, would likely appear inverted when compared to a graph 40 of current or power draw.

Figure 5:
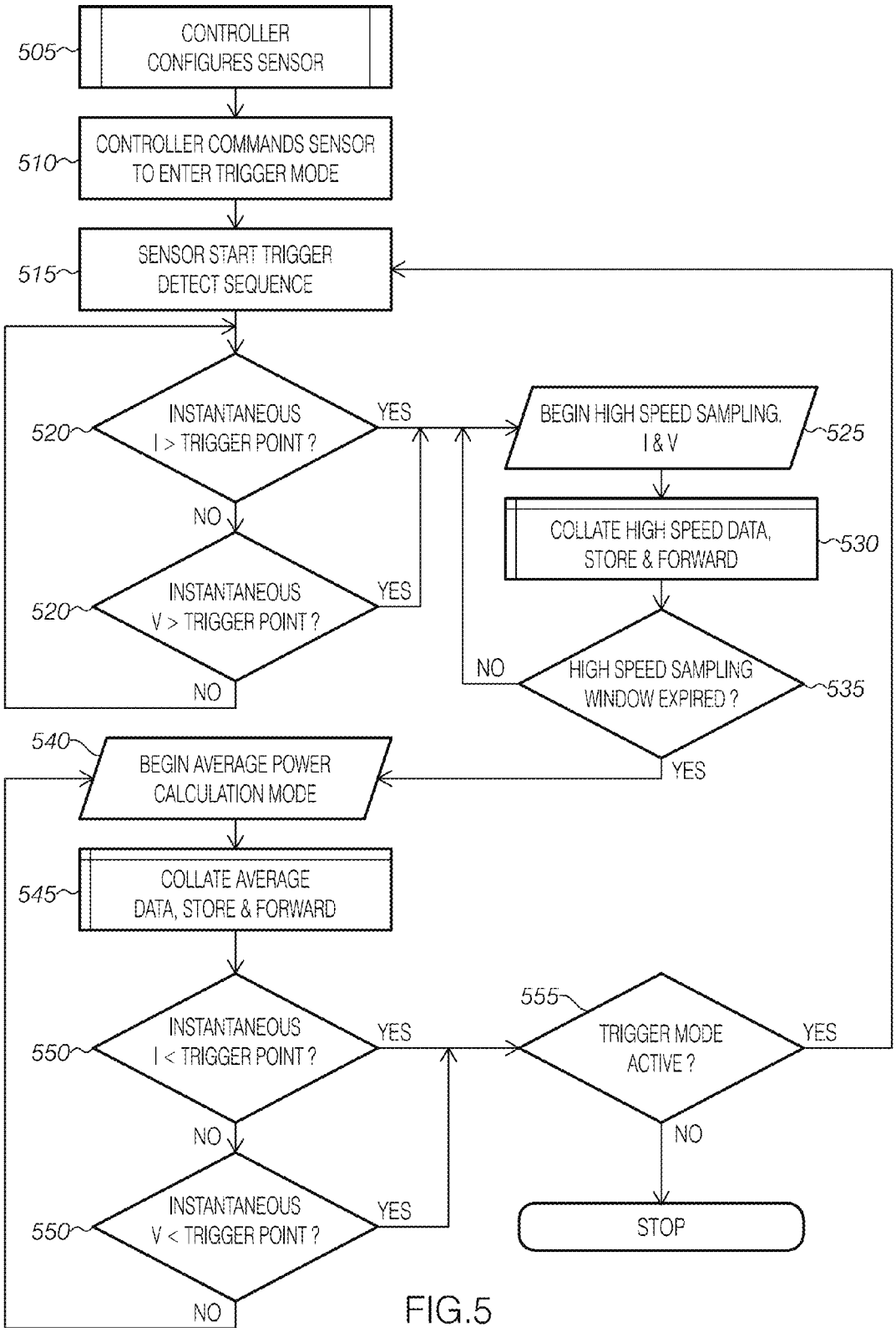
FIG. 5 is a flowchart of an example method for measuring and tracking the condition of a refrigeration unit.

Turning attention to FIG. 5, a method 500 for measuring and tracking the condition of a refrigeration unit will now be described, specifically focusing on a process that the measuring devices 110 can implement. Method 500 includes initialization step 505, where measuring devices attached to various power-consuming components of the refrigeration unit are configured, initialization step 510, where a threshold trigger is set up on the measuring devices and the measuring device is configured to initiate high-speed sampling if a threshold trigger is tripped, and initialization step 515, where the measuring devices begin monitoring power usage and detecting for the threshold trigger to be tripped. As shown in the disclosed method, the threshold trigger can be set for both current and voltage levels. In trigger step 520, if either the current or voltage threshold triggers are exceeded, high speed sampling of both current and voltage are commenced in sampling step 525. At the same time, a high speed sampling tinier begins running. The sample data is stored and forwarded to the data collection hub 130 in step 530, and in timing step 535, the measuring device checks the high speed sampling timer to determine whether the predetermined time window for high speed sampling has elapsed. If it has not elapsed, the measuring device returns to sampling step 525 to continue high speed sampling. If it has elapsed, the measuring device discontinues high speed sampling and proceeds to average monitoring step 540. In average monitoring step 540, the measuring device continues to sample voltage and current, but then determines average values for both current and voltage on a predetermined cycle time that is significantly lower than the high speed utilized in sampling step 525. This average data is stored and forwarded to the data collection hub 130 in step 545. Trigger step 550 is identical to trigger step 520, where the average data is checked for whether either of the previously established current and voltage threshold triggers are exceeded. If so, in trigger mode step 555 the measuring device determines whether the device should reenter high speed sampling. If so, the measuring device returns to sampling step 525.

The data collected by the data collection hub 130 is eventually forwarded to the analysis means 150, as described above.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A refrigeration monitoring system for tracking the condition of a refrigeration unit, comprising:

at least one monitoring device capable of sampling the power usage of a component of the refrigeration unit and converting the samples into power usage signature data, wherein:

the monitoring device's power sampling is enabled at a first preconfigured electric current-triggered threshold, the monitoring device begins sampling power usage at a pre-determined frequency upon the electric current usage of the component exceeding a second preconfigured electric current-triggered threshold, and the monitoring device switches to ongoing determination of the average power usage value after a predetermined amount of time elapses;

a data collection device in communication with the at least one monitoring device configured to receive the power usage data from the at least one monitoring device; and a network-connected computer terminal in communication with the data collection device configured to receive and analyze the power usage data for potential faults in the refrigeration unit.

2. The refrigeration monitoring system of claim 1, wherein the at least one monitoring device is attached to the power supply line of the component of the refrigeration unit.

3. The refrigeration monitoring system of claim 1, wherein the pre-determined frequency at which the least one monitoring device samples power usage is 5 kHz or faster.

4. The refrigeration monitoring system of claim 1, wherein the data collection device obtains the average power usage value from the at least one monitoring device once per second.

5. The refrigeration monitoring system of claim 1, further comprising an interface allowing a user to monitor the condition of the refrigeration unit.

6. The refrigeration monitoring system of claim 1, further comprising an Ethernet network connecting the data collection device with the at least one monitoring device.

7. The refrigeration monitoring system of claim 1, wherein said network-connected computer terminal comprises an internet-accessible hosted service.

8. A refrigeration monitoring system for tracking the condition of a refrigeration unit, comprising:

a monitoring device attached to the power line of a component of the refrigeration unit;

a data collection hub in communication with, and configured to receive power usage data from, the monitoring device, wherein:

the monitoring device is enabled to sample power usage data once the electric usage of the component crosses a first predetermined trigger threshold, the monitoring device collects power usage data by sampling the electric current usage of the component at a predetermined sample rate once the current usage crosses a second predetermined trigger threshold, and transmits the power usage data to the data collection hub, after a predetermined time, the monitoring device switches from collecting power usage data to calculating the average power consumption on an ongoing basis, and the data collection hub queries the monitoring device for the current calculated average power consumption at preconfigured time intervals; and a network-connected computer terminal in communication with the data collection hub.

9. The refrigeration monitoring system of claim 8, further comprising an Ethernet network connecting the data collection hub with the monitoring device.

10. The refrigeration monitoring system of claim 8, wherein the predetermined sample rate is 5 kHz or faster.

11. The refrigeration monitoring system of claim 10, wherein the predetermined time to switch to calculating average power consumption is 30 seconds.

12. The refrigeration monitoring system of claim 11, wherein the preconfigured time interval is one second.

* * * * *